United States Patent [19]

Lint

[11] 4,223,929

[45] Sep. 23, 1980

[54] DOOR LATCH ASSEMBLY

[76] Inventor: Robert S. Lint, 7800 Perimeter Rd. S., Seattle, Wash. 98108

[21] Appl. No.: 955,396

[22] Filed: Oct. 27, 1978

[51] Int. Cl.[2] ..... E05C 1/16

[52] U.S. Cl. ..... 292/169.18; 292/336.5; 292/357; 292/358

[58] Field of Search ..... 292/169.18, 358, 347, 292/348, 336.5, 349-356, 357

[56] References Cited

U.S. PATENT DOCUMENTS

| | | | |
|---|---|---|---|
| 1,487,975 | 3/1924 | Riddick | 292/347 X |
| 2,242,866 | 5/1941 | Kozlovskis | 292/350 |
| 3,024,055 | 3/1962 | Novarino | 292/169.18 |
| 3,179,459 | 4/1965 | Lint | 292/347 X |
| 3,339,958 | 9/1967 | Lint | 292/358X |
| 3,425,247 | 2/1969 | Etter | 292/169.18 X |

FOREIGN PATENT DOCUMENTS

| | | | |
|---|---|---|---|
| 465444 | 5/1937 | United Kingdom | 292/358 |

*Primary Examiner*—William E. Lyddane
*Attorney, Agent, or Firm*—Seed, Berry, Vernon & Baynham

[57] ABSTRACT

A door latch assembly is disclosed adapted for use with a courtesy lock mechanism which can be released in case of emergency by pushing a release stem. The latch assembly has a splined rollback operating shaft which is hollow to receive the release stem therethrough and has its splines journalled directly in the escutcheons and coupled to the handles.

2 Claims, 3 Drawing Figures

DOOR LATCH ASSEMBLY

BACKGROUND OF THE INVENTION

1. Field of the Invention

The present invention relates to door latch assemblies of the type shown in my prior U.S. Pat. Nos. 3,179,459 and 3,339,958.

2. Prior Art Relating to the Disclosure

Prior latches of the type described in the above patents have enjoyed commercial success, particularly in marine and aircraft applications, including use on lavatory doors where courtesy locks are needed. The present invention aims to provide an improved latch assembly using the same general arrangement of my previous latches, but one which has less parts than before, and is more economical to produce, without sacrificing any durability or reliability of operation. In carrying out this objective the invention also aims to provide an improved assembly which does not have to modified to accept a courtesy locking mechanism.

In carrying out the invention there is provided a hollow splined shaft which, when turned by operation of the handles, functions to operate the rollback mechanism for the bolt. The splined shaft has its splines directly journaled in escutcheons which are held against movement relative to the door. When a courtesy lock is installed the lock can be released, in case of emergency, by axially moving a releasing stem extending through the splined shaft.

PREFERRED EMBODIMENTS OF THE INVENTION

Figure 1:
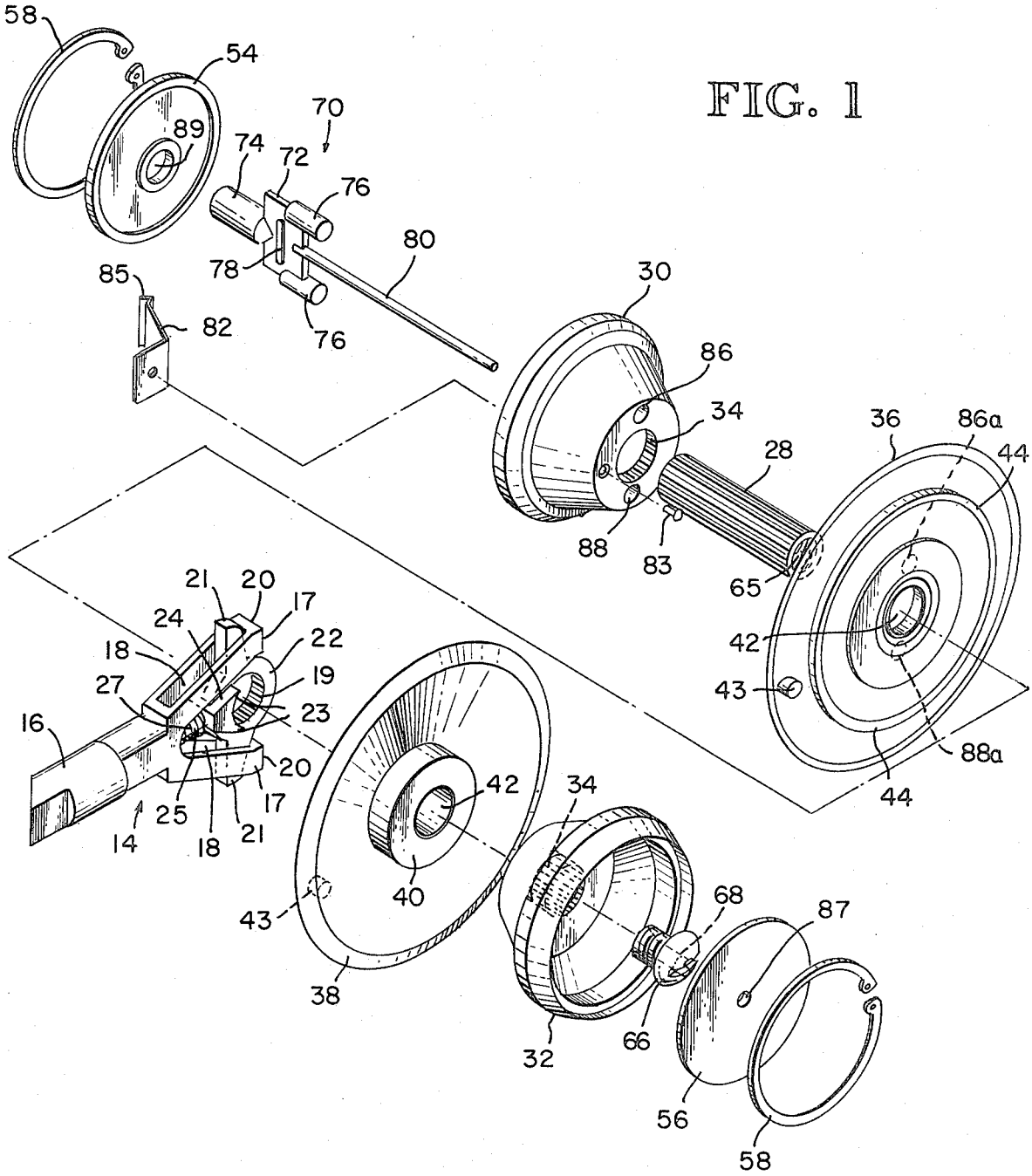
FIG. 1 is an exploded perspective view of a door latch assembly embodying the present invention.
Figure 2:
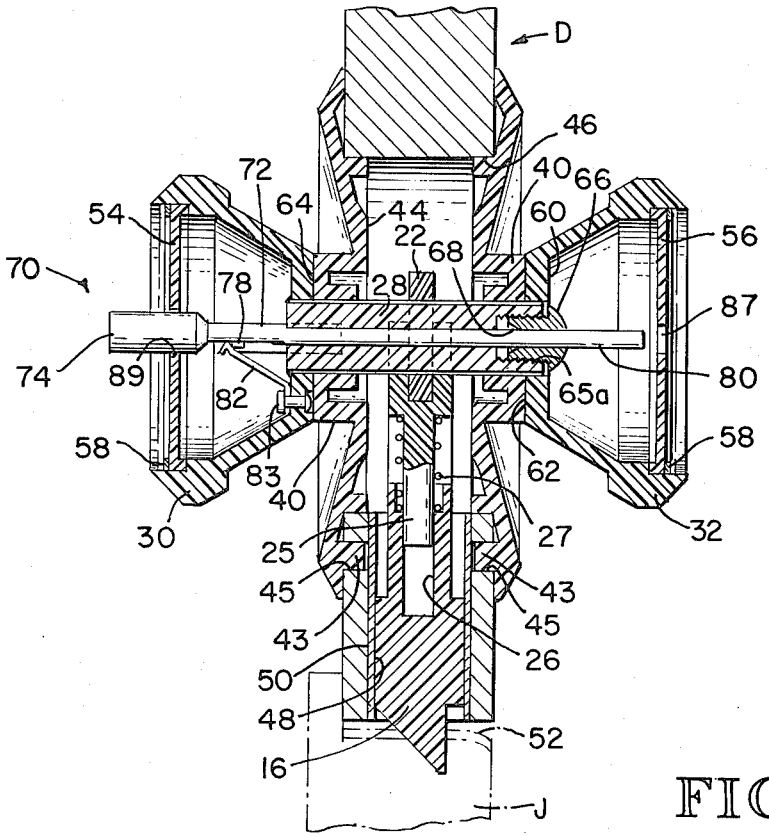
FIG. 2 is a horizontal sectional view of the latch assembly installed in a door.
Figure 3:
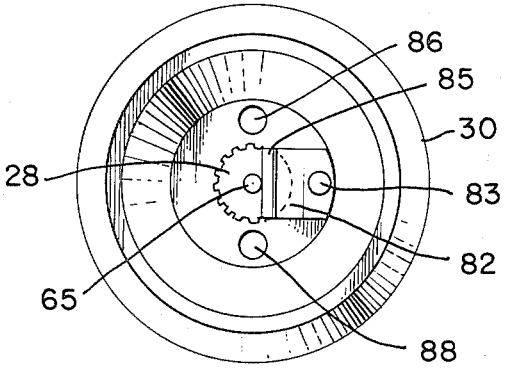
FIG. 3 is a front elevational view of the handle containing the courtesy lock and with the cover and the courtesy lock bolt removed.

Referring to the drawings, the latch assembly of the present invention includes a bolt and rollback assembly 14 generally of the type disclosed in my prior patents No. 3,179,459 and 3,339,958, namely one having its slide bolt 16 formed with inner diverging fork arms 17, each of which is longitudinally slotted at 18 and has an abutment 20 at its free end defining the respective end wall of the slot. A pair of oppositely extending rollbacks 21 project through the slots 18 from an integral central boss 22 which has a splined bore 19, the boss extending endwise of the sides of the rollbacks 21 to fit within a pair of spaced forks 23. These forks are presented by a head 24 on one end of a guide rod 25 having its other end projecting between the fork arms 17 on the bolt 16 into a bore 26 formed in the bolt along part of the length thereof. A bolt-return compression spring 27 is sleeved on the guide rod 25 to seat against the fork head 24 and bears against the closed end wall of the bore 26. This spring force yieldingly urges the rollbacks 21 against the abutments 20 at the free ends of the fork arms 17.

The boss 22 receives in its splined bore 19 a mating splined hollow shaft 28 formed as an extension of a handle 30 which is complemented by an opposed handle 32 having a splined center bore 34 to receive the free end portion of the shaft 28. This shaft can be formed integrally with the handle 30, or, as shown in the drawing, the handle 30 can also have a splined center bore 34 into which the corresponding end portion of the shaft is secured by a suitable adhesive. By this arrangement the handles 30,32 can be identical.

A pair of escutcheons 36, 38 are interposed between the handles 30, 32 and the bolt and rollback assembly 14, and each has a center front boss 40 with a throughbore 42 to serve as a bearing for the splines of shaft 28. The escutcheons are dished at the front in the area surrounding the bosses 40 and are formed at the back with an offset dowel 43 and a center rear boss 44 for interfitting, respectively, with a dowel hole 45 and a round through-opening 46 bored in the swinging door D adjacent the jamb to receive the rollback mechanism. This opening 46 is intersected by a horizontal radial hole 48 that extends from the jamb edge of the door and is somewhat larger in diameter than the bolt 16 so as to permit the bolt, rollbacks 21, guide rod 25, and spring 27 to be installed as a unit in the door by inserting the bolt 16 through the opening 46 and into the inner end of the hole 48 with the unit slightly cocked toward one face of the door until the form arms 16 reach the rim of the opening 46 to clear the door face and become completely housed in the opening 30. Then a bushing 50 is force-fitted into the hole 48 through the outer end thereof to provide a slide journal for the bolt 16. The jamb J is fitted with a strike plate 52 opposite the hole 45 having a keeper opening to receive the bolt 16 when in the normally extended position.

The handles 30, 32 are hollow and are closed at the front cover plates 54, 56 which may be retained by snap rings 58. At their rear the handles neck to a back wall 60 and each has a flat rear bearing face 62 opposing and matching the flat annular front faces 64 of the escutcheon bosses 40. Hence, unlike prior door latches, the handles do not interfit with the escutcheons for support and are not journaled within the escutcheons. Instead, by the present invention the shaft 28 is the sole support for the handles and has its splines journaled in the escutcheons.

The handle 32 is retained on the shaft 28 by a screw 66 threaded into a counter-bore **65*a* provided at the respective end of the axial bore 65 through the shaft. This screw 66 has an enlarged head with a flat rear face to bear against the front of the wall 60 of the handle 32 in the area surrounding the shaft. As an alternative the shaft 28 can be lengthened to project into the handle cavity and have the projecting portion threaded to receive a nut. So that the unit can be provided with a courtesy lock in the manner to be now described, the screw 66 is provided with a center hole 68 opening to the interior of the shaft 28 and preferably having a flared inner mouth. The courtesy lock includes a bolt unit 70 comprising a central plate 72, a center ribbed knob 74 at the outer edge of the plate, a pair of laterally spaced bolts 76 at the inner edge of the plate projecting into a pair of holes 86, 88 in the back wall of handle 30, a transverse central land 78, and an elongagted emergency lock releasing stem 80 projecting oppositely of the knob 74 between the bolts 76. This stem 80 extends through the bore 65 of the shaft 28 and the bore 68 of the screw 66 into the cavity of the handle 32. A generally U-shaped leaf spring catch 82 is anchored by a rivet 83 within the cavity of the handle 30 and presents a latching rib 85 arranged to interfit with the land 78 of the bolt unit 70 when the knob 74 is in depressed position. The knob 74 projects out of the handle cavity through a center opening 89 in tthe cover 54 and the other cover 56 has a small center hole 87 so that the free end of the stem 80 can be engaged by a hair pin or the like pushed through the hole 87 to release the bolt unit 70 in case of emergency. When the knob 74 is depressed, the bolts 76 extend into a pair of holes 86***a*, 88*a* in the front boss 40 of the escutcheon 36 which register with the holes 86, 88 in the handle 30 when the main bolt 16 is in extended position. This results in the handle 30 being locked against turning relative to the escutcheon 36 which is in turn held by the dowel 43 against turning relative to the door. The courtesy latch is readily released merely by pulling outwardly on the knob 74 until the outer edge of the plate 72 reaches the cover 54.

With the described arrangement the handle and escutcheon on each side of the door can be the same whether or not there is a courtesy lock, and the only difference in the covers 54, 56 is in the size of the holes 85, 86 if a courtesy lock is provided. The described arrangement of splined shaft 28 and hollow screw 66 (or a nut) does not have to be modified for the courtesy lock. Furthermore, the handles, escutcheons, splined shaft 28, screw 66, bolt unit 70, and covers can all be molded or otherwise formed from a suitable durable plastic such as nylon.

In my prior door latch assemblies, the shaft between the door handles had to be of such smaller-cross-section as to require, for adequate strength, the use of a square metal shaft which, for aircraft use, was formed of a special aluminum alloy. Axial boring of such a small aluminum shaft is relatively costly as compared to the splined hollow plastic shaft 28. Hence, by the use of the splined shaft 28 directly journaled in the escutcheons in accordance with the present invention, a simpler and more economical door latching assembly is made which can be provided with a courtesy lock with very little change.

I claim:

1. In a latch assembly of the type having a slide bolt slidable between extended and retracted positions, spring means urging the bolt into extended position, rollback means for retracting the bolt in opposition to the spring means and including a central boss for slidably receiving a spindle therethrough, a pair of escutcheons centrally aligned with said boss and adapted to interfit with a door and be held by the interfit against turning relative to the door, and a pair of hollow handles for manually operating the rollback means responsive to turning of the handles, the improvement comprising:

outwardly extending bosses on the escutcheons having matching journals therethrough aligned with said central boss and having outer annular faces;

said handles having back walls formed with rear annular faces opposing said boss outer faces, one of said handles having its back wall formed with a first splined through-opening registering with said journals;

said central boss having a second splined through-opening matching said first splined through-opening;

an externally splined hollow shaft journaled in said journals having its splines centrally interfitting with said second splined through-opening, and interfitting near one end with said first splined through-opening, said shaft having its other end fixed at the center of the back wall of the other of said handles and not extending into the cavity of such other handle, said shaft having its splines directly journaled in the journal of the escutcheon adjoining said one handle; and fastening means in the cavity of said one handle and screw-connected to said one end of the shaft for keeping said one handle on the shaft and the rear annular faces of the handles closely adjacent the outer annular faces of the escutcheon bosses, said fastening means having a center opening therethrough.

2. A latch assembly according to claim 1 in which courtesy latch means is mounted in the handle to which shaft is bonded and has a lock releasing stem projecting axially through said shaft and fastening means.

* * * * *